US005811744A

United States Patent [19]

Bartha

[11] Patent Number: 5,811,744

[45] Date of Patent: Sep. 22, 1998

[54] DOUBLE ELECTRICAL SWITCH

[75] Inventor: Istvan Bartha, Cary, N.C.

[73] Assignee: Ericsson Inc., Research Triangle Park, N.C.

[21] Appl. No.: 779,519

[22] Filed: Jan. 7, 1997

[51] Int. Cl.[6] ..... H01H 9/26; H01H 19/00; H01H 1/26

[52] U.S. Cl. ..... 200/5 A; 200/283; 200/6 R

[58] Field of Search ..... 200/5 A, 6 R, 200/6 A, 1 B, 245–247, 282–284, 557

[56] References Cited

U.S. PATENT DOCUMENTS 4,920,238 4/1990 Aso ..... 200/6 R 5,541,376 7/1996 Ladtkow et al. ..... 200/284

*Primary Examiner*—Michael L. Gellner
*Assistant Examiner*—Michael J. Hayes
*Attorney, Agent, or Firm*—Nixon & Vanderhye

[57] ABSTRACT

The double switch includes a core formed of insulating material and a connector formed of electrically conductive material. The connector extends along a front face of the core and has spring portions overlying a pair of isolated terminals secured on the opposite ends of the core. The connector includes a first pad lying in a plane common to second and third pads such that the switch can be mounted on a printed circuit board. By deflecting one or more of the spring portions into the second or third pad, an electrical circuit is completed between the first pad and the selected pad.

19 Claims, 3 Drawing Sheets

Fig. 6
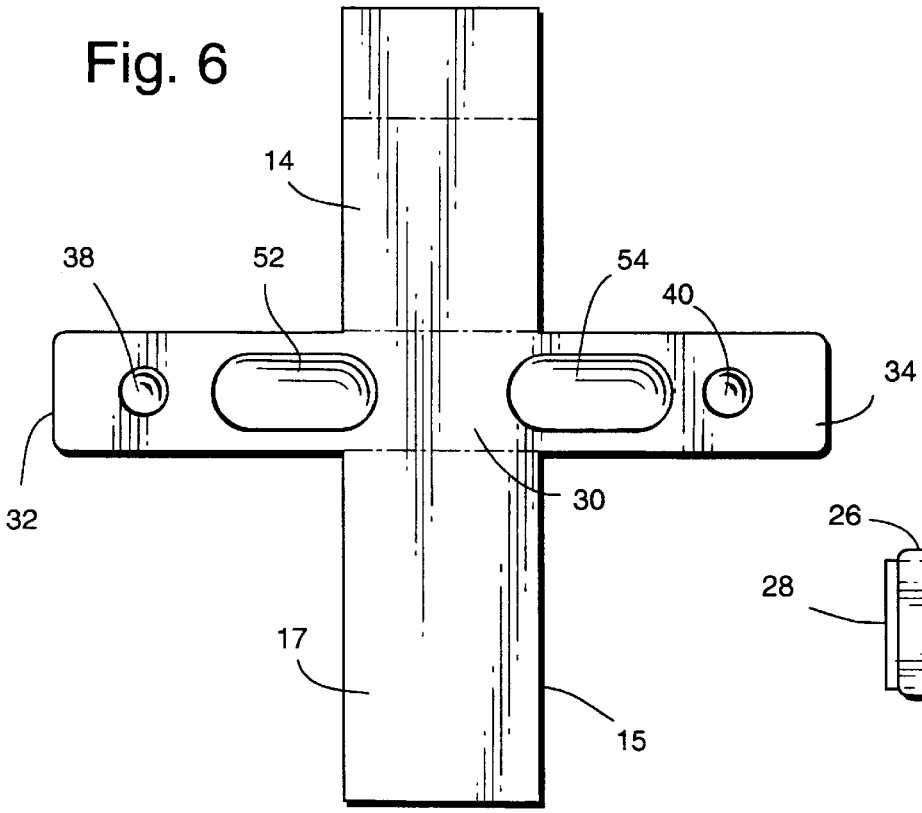
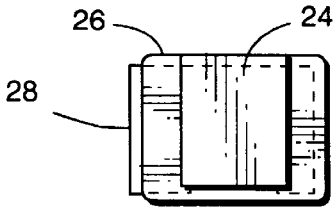
Fig. 9
Fig. 7
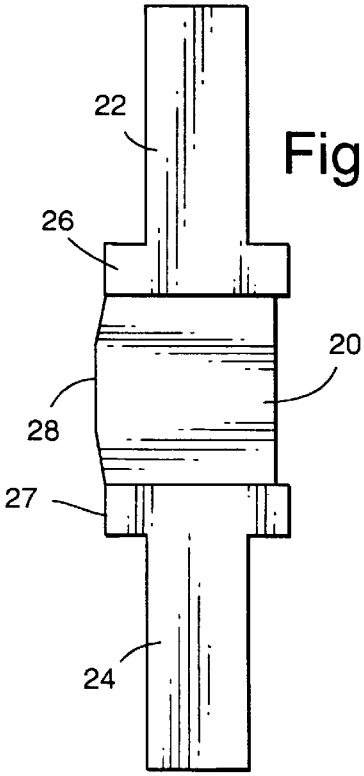
Fig. 8
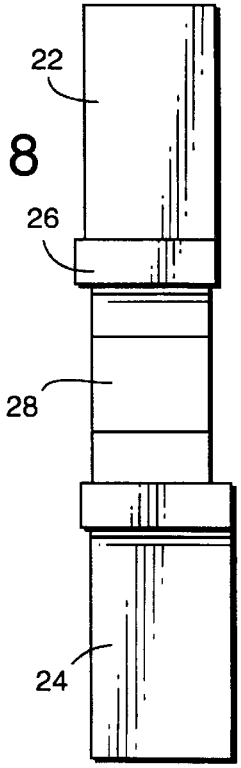

DOUBLE ELECTRICAL SWITCH

TECHNICAL FIELD

The present invention relates to a double electrical switch for placement on a printed circuit board and particularly to a double micro switch, for example, for placement below volume keys located on the long side of cellular phones.

BACKGROUND

Current switches placed, for example, within cellular phones, occupy considerable space on the internal printed circuit boards and are often of fragile, unreliable construction. Further, such switches normally have a number of pads and require certain time-consuming and, hence, costly manufacturing techniques to apply the switches to the circuit boards. One such conventional switch of this type is known as a dome switch. For side-actuated buttons, that switch is particularly difficult to assemble using automated processes and is often integrated in a flex film solution with connection and tolerance problems. The dome switch is not particularly robust and, overall, including installation, can be expensive. These switches also require a substantial number of parts which further increase the expense and assembly time.

DISCLOSURE OF THE INVENTION

The present invention provides a novel and improved double electrical switch comprised of a very minimum number of parts, e.g., in a preferred embodiment, four parts, occupies a minimum volume on the circuit board, is robust and can be readily and inexpensively produced and assembled on the circuit board by automated machinery. To accomplish the foregoing, the present invention provides a double switch having an elongated core formed of electrically insulating material, for example, a plastic material, and which core has a central enlargement including a projecting portion along a front face of the core. An electrically conductive connector is disposed about the core and constitutes one of the terminal pads or contacts for the switch. The connector also has integrally formed flexible leaf springs which form movable switch contacts. These flexible switch springs are spaced from and overlie side portions of the core whereby the springs can be resiliently flexed inward toward the core to engage and effect an electrical connection with contact surfaces of respective pads carried by the side portions of the core.

These side pads constitute, in the preferred form hereof, generally U-shaped pads disposed about the sides of the core, with the base of each pad having an electrical contact, preferably in a plane common with the contact of the first pad, for securement to the circuit board. One of the legs of each of the U-shaped pads lies opposite a flexible spring and serves as an electrical contact surface for the spring. Consequently, the first pad may constitute an electrical contact, for example, an electrical input to the switch, while the remaining two pads constitute electrical contacts, for example, two output terminals. Thus, by pressing the spring portions against the respective second and third pads, an electrical circuit can be completed between the first pad and second pad and between the first pad and third pad, respectively.

From the foregoing, it will be appreciated that the switch is of robust and simplified construction. For example, the core constitutes a rectilinear member having a central enlargement which can be readily molded of electrically insulating material. The connector essentially comprises flat sheet metal in the shape of a cross which can be bent about fold axes for clamping the connector to the central portion of the core. Alternatively, the connector can be adhesively, ultrasonically welded, heat staked or otherwise secured to the core. With the integral cross-shaped connector, a pair of legs on opposite sides of the cross form the respective spring portions of the switch which underlie a control for the cellular phone, for example, a volume control. The remaining two pads are formed identically with respect to one another and constitute generally channel or U-shaped members disposed about the side portions of the core. The two channel-shaped pads may be crimped or otherwise secured to the core. With that configuration, the bases of the channel-shaped pads advantageously have contacts lying in a common plane along the underside of the switch with the contact of the first pad whereby the switch can be readily secured to a flat printed circuit board.

To assist the securement of the switch to the board, one of the legs of the cross-shaped connector overlies the enlargement of the core on a side of the switch opposite the contacts of the pads. This provides a substantial area along the top or upper face of the connector facilitating placement of the switch on the circuit board. That is, by providing a large top area, a vacuum cup forming part of automated assembly equipment may be used to engage, pick up, transport and dispose the switch in a predetermined position on a circuit board.

Additionally, indentations may be formed on the spring portions projecting toward the second and third pads, respectively, to ensure good electrical contact with the pads. Additional elliptically-shaped indentations may also be formed for cooperation with the enlargement of the core to emit an audible sound, such as a clicking sound, representative of the closing of the switch thereby signaling to the user a closing of the switch.

In a preferred embodiment according to the present invention, there is provided a double switch comprising an elongated core formed of electrical insulating material, and a connector formed of electrically conductive material and having a front portion along a length of the core. The front portion includes a pair of spring portions spaced from one another and forwardly of the core and movable toward and away from the core. The connector includes a first pad having an electrical contact and second and third pads carried by said core and having respective electrical contacts and second and third contact surfaces for engagement by the spring portions, respectively, whereby movement of the spring portions toward and into engagement with the second and third contact surfaces completes circuits between the first contact and the second contact, and the first contact and the third contact, respectively.

In a further preferred embodiment according to the present invention, there is provided a double switch comprising an elongated core formed of electrical insulating material and having intermediate and end portions therealong, and a connector formed of electrically conductive material and having a front portion overlying a front face of the intermediate portion of the core. The front portion includes a pair of spring portions spaced from one another and forwardly of the end portions of the core and movable toward and away from the portions. The connector includes a generally cross-shaped element having legs on opposite sides of the front portion overlying opposite faces of the core along the intermediate portion thereof with one of the legs forming a first pad having an electrical contact, the opposite faces of the intermediate portion of the core being inset for receiving side legs, respectively, whereby the connector is clamped about the intermediate portion of the core. The switch additionally includes second and third pads carried by the core adjacent opposite end portions thereof, the second and third pads having respective electrical contacts and second and third contact surfaces for engagement by the spring portions, respectively, whereby movement of the spring portions toward and into engagement with the second and third contact surfaces completes circuits between the first contact and the second contact, and the first contact and the third contact, respectively.

Accordingly, it is a primary object of the present invention to provide a novel and improved double electrical switch having a minimum number of parts which can be readily and easily assembled relative to one another and readily and easily secured to a printed circuit board.

BRIEF DESCRIPTION OF THE DRAWINGS

FIG. 6 is a plan view of the connector prior to folding about the core;

FIG. 7 is a top plan view of the core;

FIG. 8 is a front elevational view of the core; and

FIG. 9 is an end elevational view of the core.

BEST MODE FOR CARRYING OUT THE INVENTION

Figure 1:
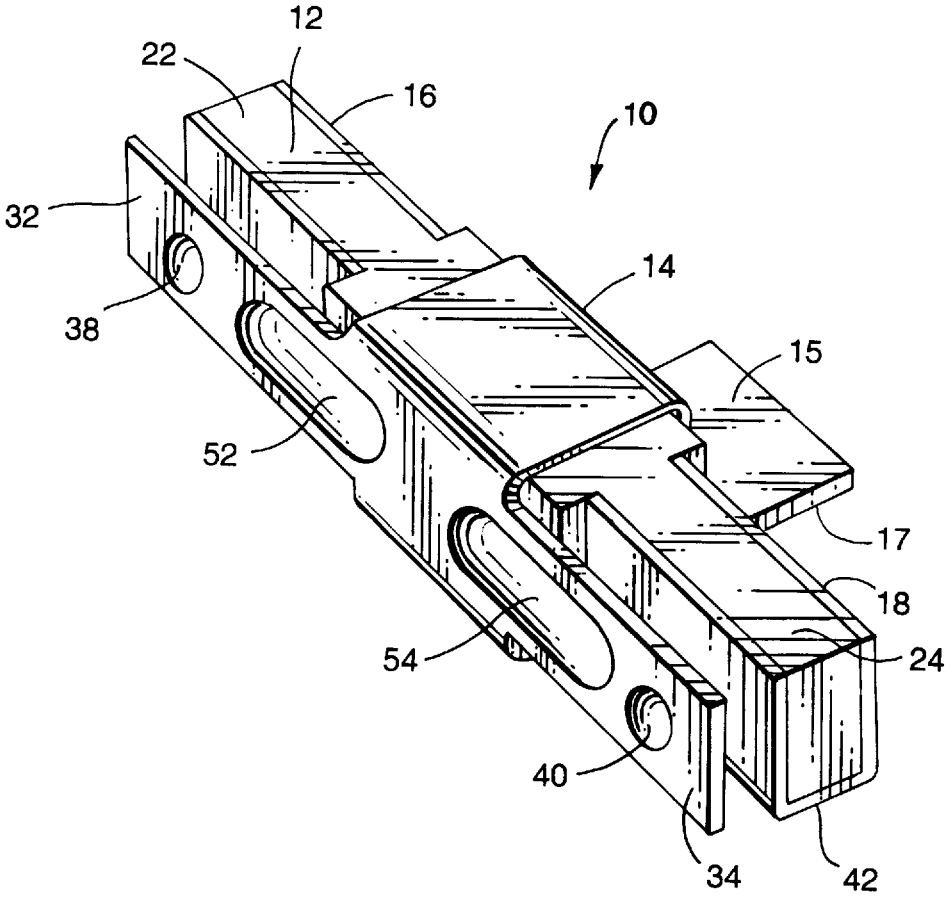
FIG. 1 is a perspective view of a double electrical switch according to the present invention.

Referring now to the drawings, particularly to FIG. 1, there is illustrated a double electrical switch constructed in accordance with the present invention and generally designated 10. Switch 10 includes four parts: namely, a support core 12, a connector 14 having a first terminal or pad 15 and two electrical terminals or pads 16 and 18 disposed on opposite side portions or ends of the core 12. The core 12 may be formed of electrically insulating non-brittle plastic or ceramic material. Referring to FIGS. 7–8, the core 12 is generally rectilinear in configuration having a length, width and height, with a central enlargement 20. Upon comparison of FIGS. 7 and 8, rectilinear side portions 22 and 24 extend from opposite sides of the central enlargement 20. The enlargement 20 includes a pair of longitudinally spaced flanges 26 which project forwardly, rearwardly and downwardly of the switch. Between the forward projections 27 of flanges 26, there is provided a forwardly projecting front surface 28, the top, bottom and rear sides of enlargement 20 being set back or inset from the flanges 26 as indicated by the dashed lines of FIG. 9 and illustrated in FIGS. 7 and 8. Optionally, the core may not have any enlargement with flanges.

Figure 4:
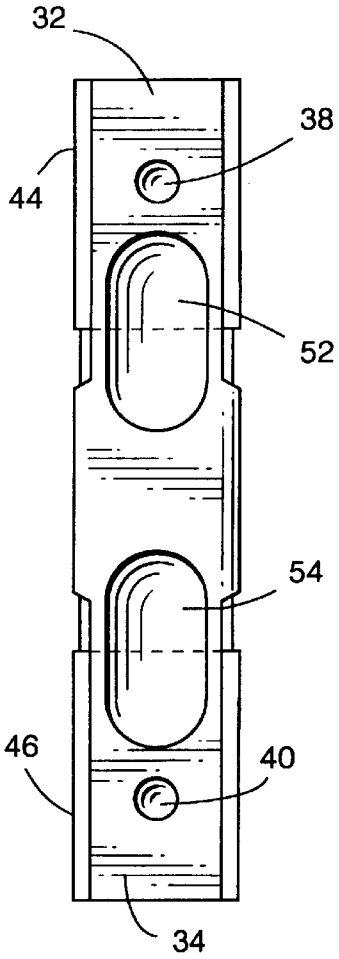
FIG. 4 is a front elevational view of the switch of FIG. 1.
Figure 3:
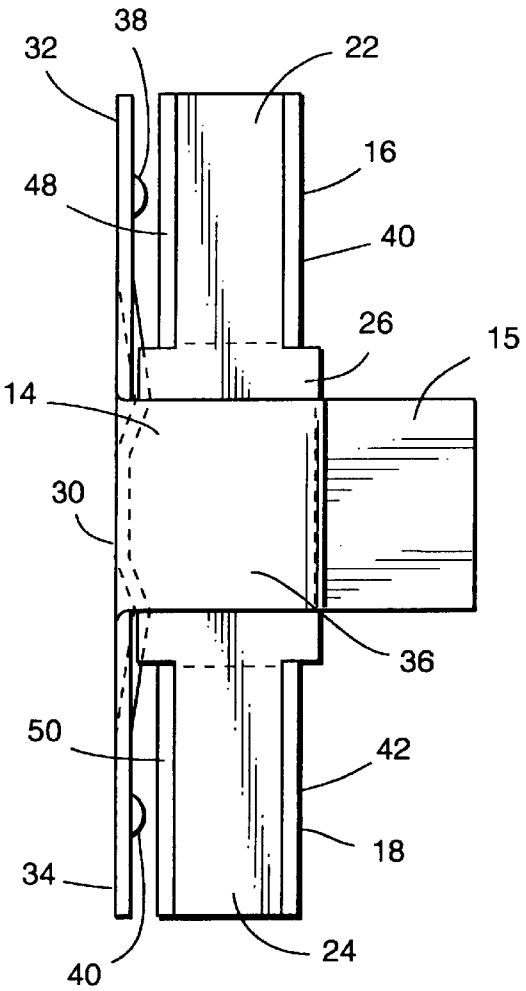
FIG. 3 is a top plan view of the switch illustrated in FIG. 1.

Referring to FIGS. 3 and 4, connector 14 includes a front face portion 30 for overlying the front surface 28 of core 12. The front face 30 also has two spring portions 32 and 34 integrally formed therewith and extending to opposite sides in spaced overlying relation to the rectilinear side portions 22 and 24 of the core 12. Thus, the spring portions 32 and 34 are cantilevered from the central front face portion of connector 14 for movement toward and away from the side portions 22 and 24 of the core 12. The spring portions 32 and 34 are biased such that they do not contact the U-shaped electrical terminals 16 and 18, until acted upon by an outside force (finger). The central portion 30 of the connector 14 overlies front face 28 of core 12 and has a lower leg which is folded to extend at right angles to the front face 28 and between the flanges 26 of the core, terminating in a rearwardly cantilevered first pad 15. As illustrated, pad 15 projects to the opposite side of the switch 10 from the front face of the connector and its undersurface forms an electrical contact 17 for electrical connection to the circuit board. An opposite leg 36 of the connector 14 overlies the upper surface of core 12 between the flanges 26 and is folded at right angles to extend along the back side of core 12. By folding these leg portions about the central enlargement 20 of the core and between the flanges 26, the connector 14 is clamped to the core. It will be appreciated that other forms of securement of the connector to the core may be provided, e.g., by an adhesive or by mechanical-type connections. However, by simply enveloping or encapsulating the enlargement 20 at least partially on all of its four sides between flanges 26, further structural interconnection between the connector and core is not required. The spring portions 32 and 34 have indentations 38 and 40 which project toward the side portions of the core, for purposes which will become clear from the ensuing description.

Referring again to FIG. 1, electrical terminals 16 and 18, i.e., second and third pads 16 and 18, comprise generally U or channel-shaped members 41 and 42, respectively. The base portions of the channel-shaped members form contacts 44 and 46, respectively, for connection, for example, by soldering or otherwise, with an electrical circuit board, while the forwardly facing legs of the members 41 and 42 form contact surfaces 48 and 50, respectively, lying on the forward side of the core 12 in spaced opposition to the back side of spring portions 32 and 34. Consequently, it will be appreciated that by deflecting the spring portions 32 and 34, the contact indentations 38 and 40 may selectively engage the upstanding legs, i.e., contact surfaces 48 and 50, of the pads 16 and 18 and form electrical connections therewith. The pads 16 and 18 may be secured to the side portions of the core by any suitable means, such as adhesives or mechanically. Note also that the bases of the members 41 and 42 forming the contacts 44 and 46 of the second and third pads, respectively, for electrical connection to the circuit board lie in a plane common to the plane containing the the contact of first pad 15.

Optionally, the spring portions 32 and 34 may carry a second pair of generally oblong-shaped indentations 52 and 54 between the contact indents 38 and 40 and the central portion 30 of the connector. These oblong indentations 52, 54 may lie opposite flanges 26 for deflection outwardly upon deflection of the spring portions inwardly toward the contact surfaces 48 and 50 of the pads 16 and 18, respectively. Upon deflection of the spring portions, the oblong indentations deflect, creating an audible noise or sound indicative of the closing of the electrical circuit.

One of the features of the present invention resides in the formation of a relatively large planar surface on the top of the switch opposite the contacts 17, 44 and 46 of the pads 15, 16 and 18, respectively, which will engage the printed circuit board. By forming a large surface area generally parallel to the printed circuit board adjacent the top face of the switch, the placement of the switch on the circuit board is adaptable to automated positioning devices. For example, a vacuum cup may be engaged against the top surface of the switch, enabling the switch to be lifted by the cup and transferred into the proper position on the circuit board. Thus, by removing the vacuum pressure, the vacuum cup can be removed with the pads being accurately positioned on the circuit board for securement and appropriate electrical contact.

Figure 2:
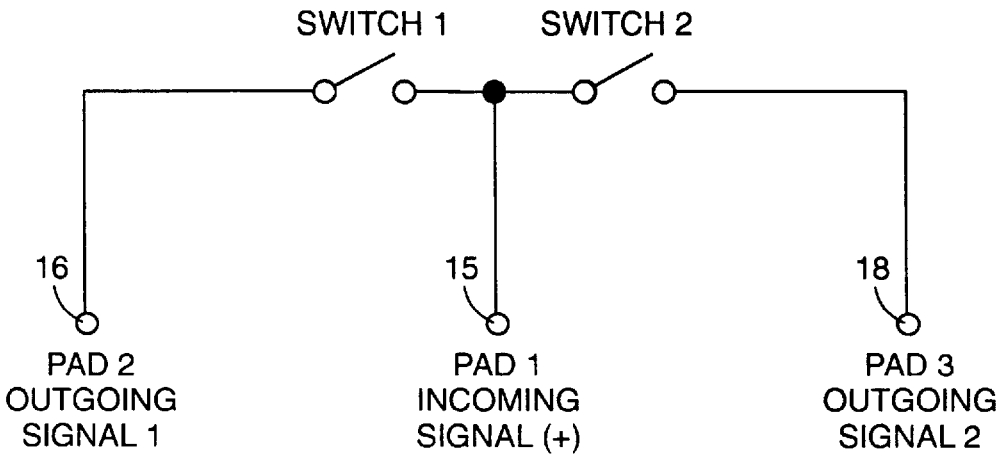
FIG. 2 is a circuit diagram showing the electrical equivalent of the mechanical switch.
Figure 5:
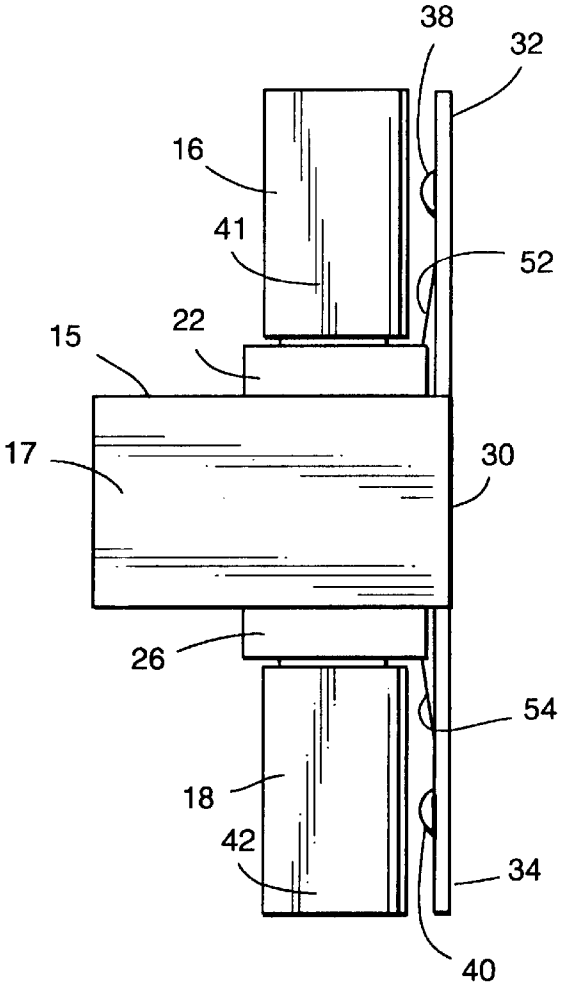
FIG. 5 is a bottom plan view thereof.

In using the switch hereof, it will be appreciated that it underlies one or more control buttons, for example, on a radio, which can be depressed by a user. It will be appreciated with reference to FIG. 2 that springs 32 and 34 constitute normally open switches 1 and 2 with pads 16 and 18, respectively. When one of the spring portions is depressed such that the indent thereof engages the second or third terminal, i.e., contact surfaces 48 and 50, an electrical circuit is completed between the engaged pad 16 or 18 and the first pad 15. Referring to FIG. 2, if the first pad 15 is coupled to an electrical input on the circuit board, a circuit including pad 15 would be completed to the pad engaged by the spring and a second circuit to the opposite pad would remain open as a result of the spacing of the other spring from the pad. For example, when switch 1 is closed by depressing spring 32 to engage pad 16, a first circuit including pads 15 and 16 is completed (e.g., to increase volume). The switch 2 remains open. Conversely, when switch 2 is closed by depressing spring 34 to engage pad 18, a second circuit including pads 15 and 18 is completed (e.g., to decrease volume). Switch 1 remains open.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A double switch comprising:

an elongated core formed of electrical insulating material;

a connector formed of electrically conductive material and having a front portion along a length of said core, said front portion including a pair of spring portions spaced from one another and forwardly of said core and movable toward and away from said core, said connector including a first pad having a first electrical contact; and second and third pads carried by said core and having respective second and third electrical contacts and respective second and third contact surfaces for engagement by said spring portions, respectively, whereby movement of said spring portions toward and into engagement with said second and third contact surfaces completes circuits between said first contact and said second contact, and said first contact and said third contact, respectively, the electrical contacts of said first, second and third pads lying in a common plane for connection to a flat circuit board.

2. A switch according to claim 1 wherein said connector comprises a generally cross-shaped element having legs in spaced parallel planes on opposite sides of said front portion overlying opposite sides of said core with one of said legs forming said first pad.

3. A switch according to claim 2 wherein said core includes a central front portion thereof, said front portion of said connector overlying said front portion of said core, said one leg having a portion overlying a portion of said core other than said front portion.

4. A switch according to claim 1 wherein said first pad is cantilevered from the switch on a side thereof remote from said front portion of said connector.

5. A switch according to claim 1 wherein said core has a forwardly projecting front surface at least along a central front portion thereof, said connector front portion overlying said forwardly projecting front surface of said core with said spring portions lying on opposite sides of said connector front portion and normally spaced from respective side portions of said core on opposite sides of said central front portion thereof.

6. A switch according to claim 5 wherein said contact surfaces of said second and third pads are disposed between side portions of said core along said central front portion thereof and said spring portions for engagement by said spring portions upon deflection thereof toward said contact surfaces, respectively.

7. A switch according to claim, 6 wherein said second and third contact surfaces of said second and third pads, respectively, lie in a common plane, said electrical contacts of said first, second and third pads lying in a common plane substantially perpendicular to said plane containing said second and third contact surfaces, said spring portions lying in a plane spaced forwardly from and lying generally parallel to said plane containing said second and third contact surfaces.

8. A switch according to claim 5 wherein said spring portions include indentations therealong projecting toward said contact surfaces.

9. A switch according to claim 5 wherein said second and third pads comprise generally U-shaped elements disposed about respective side portions of said core, said contact surfaces of said second and third pads being disposed between side portions of said core and said spring portions for engagement by said spring portions upon deflection thereof toward said contact surfaces, respectively, second and third pads lying in a plane generally parallel with said electrical contact of said first pad.

10. A switch according to claim 1 wherein said core has a central enlargement intermediate opposite ends thereof and has a projection at least along a central front portion thereof, said connector front portion overlying said projection of said central front portion of said core with said spring portions lying on opposite sides of said connector front portion and normally spaced from respective side portions of said core on opposite sides of said central portion thereof, said connector having a portion overlying said enlargement providing a substantial area for pick-up by a vacuum cup and placement on a circuit board.

11. A switch according to claim 5 wherein said connector front portion includes a pair of collapsible dents projecting toward said core and responsive to respective displacement of said spring portions into engagement with said core to collapse and emit an audible signal representing completion of said circuits.

12. A double switch comprising:

an elongated core formed of electrical insulating material and having intermediate and end portions therealong;

a connector formed of electrically conductive material and having a front face portion overlying a front surface of said intermediate portion of said core, said front face portion including a pair of spring portions spaced from one another and forwardly of said end portions of said core and movable toward and away from said end portions, said connector including a generally cross-shaped element having legs in generally parallel planes on opposite sides of said front face portion overlying opposite faces of said core along said intermediate portion thereof with one of said legs forming a first pad having an electrical contact;

the opposite faces of said intermediate portion of said core being inset for receiving said legs, respectively, whereby said connector is clamped about the intermediate portion of said core;

second and third pads carried by said core adjacent said opposite end portions thereof, said second and third pads having respective electrical contacts and second and third contact surfaces for engagement by said spring portions, respectively, whereby movement of said spring portions toward and into engagement with said second and third contact surfaces completes circuits between said first contact and said second contact, and said first contact and said third contact, respectively.

13. A switch according to claim 12 wherein the electrical contacts of said first, second and third pads lie in a common plane for connection to a flat circuit board.

14. A switch according to claim 12 wherein said first pad is cantilevered from the switch on a side thereof remote from said front surface portion of said core.

15. A switch according to claim 12 wherein said core has a forward projection in part defining said front surface thereof, said connector front face portion overlying said core front surface with said spring portions lying on opposite sides of said connector front face portion and normally spaced from respective end portions of said core on opposite sides of said intermediate portion thereof.

16. A switch according to claim 15 wherein said contact surfaces of said second and third pads are disposed between side portions of said core and said spring portions for engagement by said spring portions upon deflection thereof toward said contact surfaces, respectively, said electrical contacts of said first, second and third pads lying in a common plane.

17. A switch according to claim 16 wherein said contact surfaces of said second and third pads lie in a common plane, said contacts of said first, second and third pads lying in a common plane substantially perpendicular to said plane containing said contact surfaces, said spring portions lying in a plane spaced forwardly from and lying generally parallel to the plane containing said spring portions.

18. A switch according to claim 15 wherein said spring portions includes indentations therealong projecting toward said contact surfaces.

19. A switch according to claim 16 wherein said second and third pads comprise generally U-shaped elements disposed about respective end portions of said core, said contact surfaces of said second and third pads being disposed between end portions of said core and said spring portions for engagement by said spring portions upon deflection thereof toward said contact surfaces, respectively, said contacts of said second and third pads lying in a plane generally parallel with said contact of said first pad.

* * * * *